US007204729B2

(12) United States Patent
Wu

(10) Patent No.: US 7,204,729 B2
(45) Date of Patent: Apr. 17, 2007

(54) FIXING AUXILIARY DEVICE

(75) Inventor: Wen-Ching Wu, Taoyuan Hsien (TW)

(73) Assignee: Delta Electronics, Inc., Taoyuan Hsien (TW)

( * ) Notice: Subject to any disclaimer, the term of this patent is extended or adjusted under 35 U.S.C. 154(b) by 0 days.

(21) Appl. No.: 11/251,718

(22) Filed: Oct. 17, 2005

(65) Prior Publication Data

US 2006/0281347 A1 Dec. 14, 2006

(30) Foreign Application Priority Data

Jun. 8, 2005 (TW) ..... 94118944 A

(51) Int. Cl.
*H01R 4/02* (2006.01)

(52) U.S. Cl. ..... 439/876; 439/83

(58) Field of Classification Search ..... 439/876, 439/83, 487, 361

See application file for complete search history.

(56) References Cited

U.S. PATENT DOCUMENTS 4,446,504 A * 5/1984 Jordan et al. ..... 361/715
4,629,278 A * 12/1986 Norton et al. ..... 439/570
4,705,205 A * 11/1987 Allen et al. ..... 228/180.22
5,451,174 A * 9/1995 Bogursky et al. ..... 439/876
5,476,389 A * 12/1995 Ono ..... 439/83
5,624,269 A * 4/1997 Kanamori ..... 439/83
5,957,736 A * 9/1999 Moriuchi et al. ..... 439/876
6,717,425 B2 * 4/2004 McClure et al. ..... 324/761
2001/0021611 A1 * 9/2001 Onizuka et al. ..... 439/876
2005/0042941 A1 * 2/2005 Keating et al. ..... 439/876

* cited by examiner

*Primary Examiner*—Tulsidas C. Patel
*Assistant Examiner*—Vladimir Imas

(57) ABSTRACT

A fixing auxiliary device includes a main body, at least an extension arm and an adhesive element. The main body has a first portion in contact with a connecting portion of a circuit board and a second portion coupled to an extension plate of a metallic assembly. The at least an extension arm extends from an edge of the main body and is bent toward one side of the main body so as to clamp the extension plate of the metallic assembly. The adhesive element is used for bonding the first portion of the main body onto the connecting portion of the circuit board.

20 Claims, 8 Drawing Sheets

FIXING AUXILIARY DEVICE

FIELD OF THE INVENTION

The present invention relates to a fixing auxiliary device, and more particularly to a fixing auxiliary device for facilitating a user to fix a metallic assembly onto a circuit board.

BACKGROUND OF THE INVENTION

With increasing integration of integrated circuits, electronic devices such as power adapters and power supply apparatuses are developed toward minimization. As the volume of the electronic device is decreased, the problem associated with heat dissipation becomes more serious. Take a power adapter for example. When the power adapter operates, the electronic components mounted on the printed circuit board thereof may generate energy in the form of heat, which is readily accumulated within the closed space and usually difficult to dissipate away. If the power adapter fails to transfer enough heat to ambient air, the elevated operating temperature may result in damage of the electronic components, a breakdown of the whole power adapter or reduced power conversion efficiency. In addition, when an electronic device is in the vicinity of an electromagnetic field in the radio frequency (RF) spectrum that is caused by another electronic component, EMI (electromagnetic interference) results in operational disruption of the electronic component. Problems with EMI and heat dissipation can be minimized by placing a metallic assembly such as an EMI shielding element or a heat sink on a surface of the circuit board.

In order to attach and/or fix the metallic assembly onto the circuit board, the metallic assembly usually includes an extension plate inserting into corresponding insertion holes of the circuit board. After the extension plate is welded onto the circuit board by using a soldering material, the extension plate is fixed on the circuit board. Alternatively, the extension plate may be directly welded onto the circuit board. The metallic assembly is usually made of high thermally conductive material such as aluminum. As known, aluminum is not well bonded to the soldering material.

In order to enhance fixing effect, a conventional fixing auxiliary device for facilitating a user to fix a metallic assembly onto a circuit board is illustrated with reference to FIG. 1. The metallic assembly 12 comprises an extension plate 120 with a perforation 121. The circuit board 11 has therein an insertion hole 110. The fixing auxiliary device 13 comprises a main body 130, a screw 131 and a nut 132. The main body 130 comprises another perforation 133 corresponding to the perforation 121 of the extension plate 120. For fixing the metallic assembly 12, the main body 130 is first combined with the metallic assembly 12 when the screw 131 penetrates through the perforations 133 and 121 and is screwed into the nut 132, and then the bottom of the main body 130 is insert into the insertion hole 110. Afterward, the main body 130 is welded onto the circuit board by using a soldering material.

Since the fixing auxiliary device 13 comprises many components and the process for fixing the metallic assembly 12 onto the circuit board 11 is complicated, the use of the fixing auxiliary device 13 is not feasible. In addition, if the screw 131 is not tightly screwed into the nut 132, the metallic assembly 12 would be pivotal about the fixing auxiliary device 13 and thus the metallic assembly is not securely attached onto the circuit board 11.

In views of the above-described disadvantages, the applicant keeps on carving unflaggingly to develop an improved fixing auxiliary device according to the present invention through wholehearted experience and research.

SUMMARY OF THE INVENTION

An object of the present invention is to provide a fixing auxiliary device for facilitating a user to fix a metallic assembly onto a circuit board, in which the fixing auxiliary device has a simple structure and the process for using the fixing auxiliary device is simplified.

Another object of the present invention is to provide a fixing auxiliary device for facilitating a user to securely fix a metallic assembly onto a circuit board.

In accordance with a first aspect of the present invention, there is provided a fixing auxiliary device for facilitating a user to fix a metallic assembly onto a circuit board. The fixing auxiliary device comprises a main body, at least an extension arm and an adhesive element. The main body has a first portion in contact with a connecting portion of the circuit board and a second portion coupled to an extension plate of the metallic assembly. The at least an extension arm extends from an edge of the main body and is bent toward one side of the main body so as to clamp the extension plate of the metallic assembly. The adhesive element is used for bonding the first portion of the main body onto the connecting portion of the circuit board.

Preferably, the metallic assembly is an EMI shielding element or a heat sink.

In an embodiment, the connecting portion of the circuit board includes an insertion hole, and the first portion of the main body is a leg portion inserting into the insertion hole of the circuit board.

In an embodiment, the insertion hole is a conductive via hole, and the leg portion is disposed at the bottom of the main body and integrally formed with the main body.

In an embodiment, the connecting portion of the circuit board includes a contact pad, and the first portion of the main body is a bent portion perpendicular to the main body and parallel to a surface of the circuit board.

In an embodiment, the connecting portion of the circuit board further includes a stub, and the first portion of the main body is a bent portion having a curved channel for partially accommodating the stub.

In an embodiment, the second portion of the main body is a perforation corresponding to a protrusion part of the extension plate of the metallic assembly, and the protrusion part of the extension plate is embedded into the perforation of the main body.

In an embodiment, the at least an extension arm comprises two extension arms extending from opposite edges of the main body and bent toward the same side of the main body so as to tightly clamp the extension plate of the metallic assembly.

In an embodiment, the at least an extension arm is integrally formed with the main body.

Preferably, the metallic assembly is made of aluminum, and the main body of the fixing auxiliary device is made of copper or tin.

Preferably, the adhesive element is made of a soldering material.

In accordance with a second aspect of the present invention, there is provided a packaging structure of a metallic assembly. The packaging structure comprises a circuit board, a metallic assembly and a fixing auxiliary device. The circuit board has at least a connecting portion. The metallic assembly is mounted on a surface of the circuit board and having at least an extension plate. The fixing auxiliary device comprises a main body, at least an extension arm and an adhesive element. The main body has a first portion in contact with a connecting portion of the circuit board and a second portion coupled to an extension plate of the metallic assembly. The at least an extension arm extends from an edge of the main body and is bent toward one side of the main body so as to clamp the extension plate of the metallic assembly. The adhesive element is used for bonding the first portion of the main body onto the connecting portion of the circuit board.

The above contents of the present invention will become more readily apparent to those ordinarily skilled in the art after reviewing the following detailed description and accompanying drawings, in which:

DETAILED DESCRIPTION OF THE PREFERRED EMBODIMENT

The present invention will now be described more specifically with reference to the following embodiments. It is to be noted that the following descriptions of preferred embodiments of this invention are presented herein for purpose of illustration and description only. It is not intended to be exhaustive or to be limited to the precise form disclosed.

Figure 1:
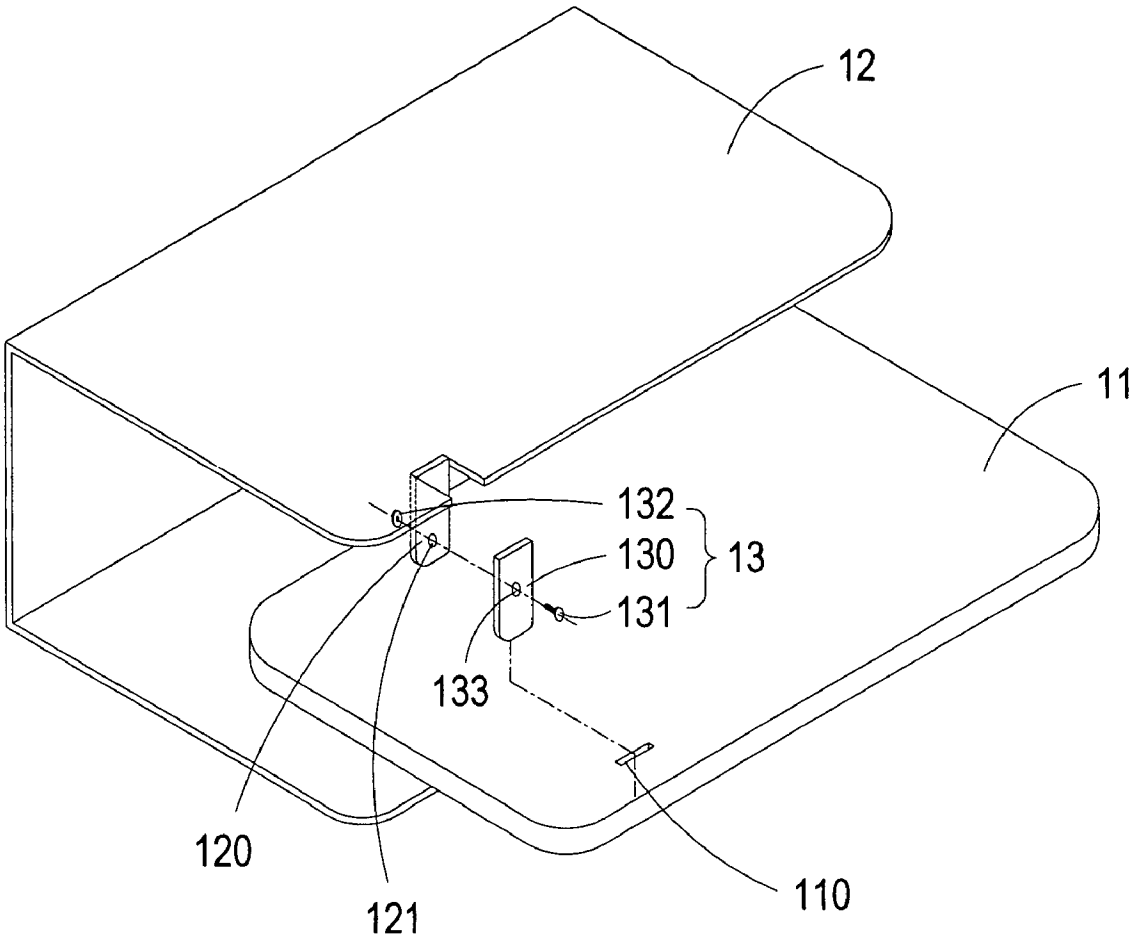
Fig. 1 Prior Art
FIG. 1 illustrates a conventional fixing auxiliary device for facilitating a user to fix a metallic assembly onto a circuit board.
Figure 2:
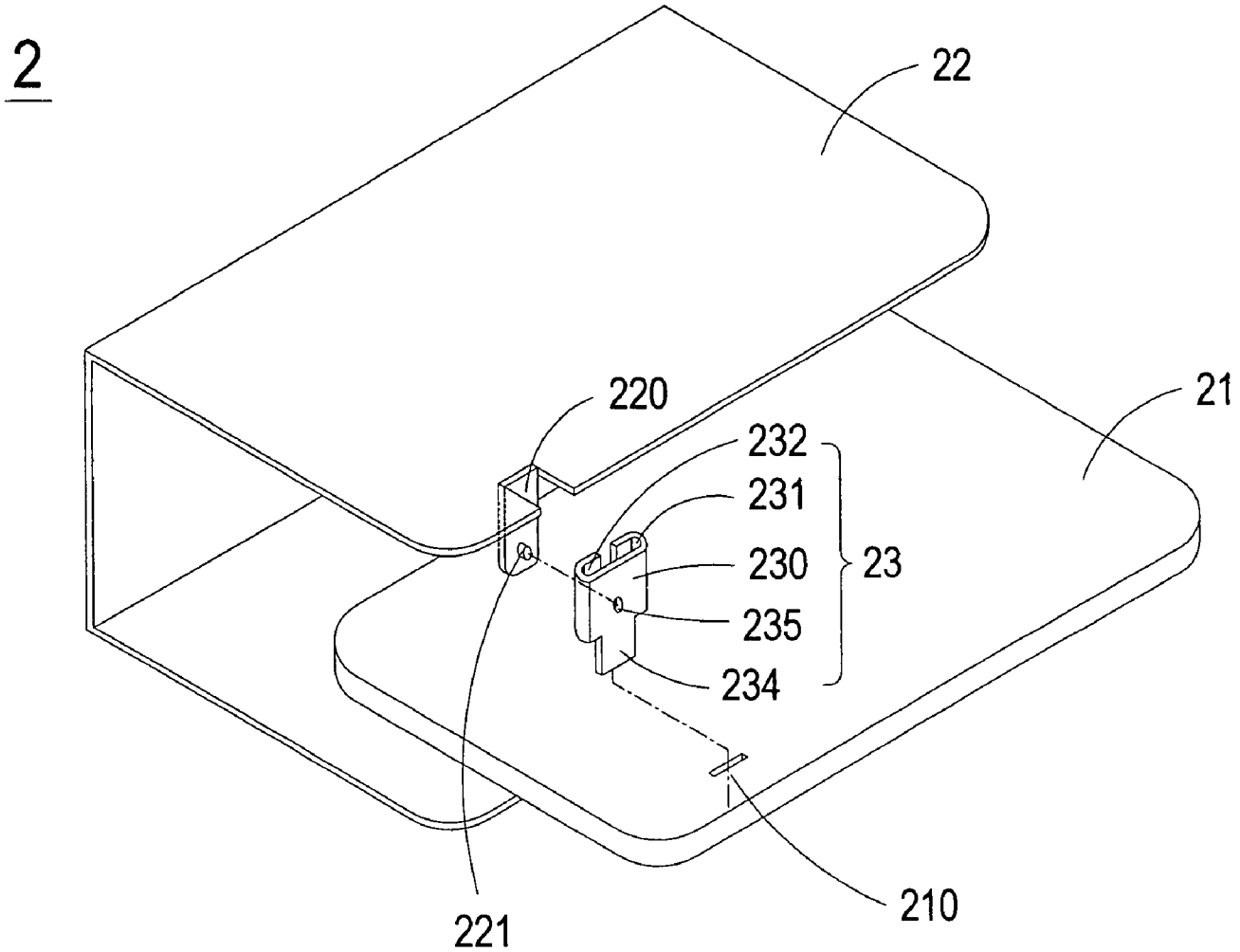
FIG. 2 illustrates a fixing auxiliary device for facilitating a user to fix a metallic assembly onto a circuit board according to a preferred embodiment of the present invention.

Referring to FIG. 2, a fixing auxiliary device for facilitating a user to fix a metallic assembly onto a circuit board according to a preferred embodiment of the present invention is illustrated. The circuit board 21 has therein one or more connecting portions such as an insertion hole 210. In an embodiment, the insertion hole 210 is arranged on the rear side of the circuit board 21. The metallic assembly 22 is disposed on the front side and/or rear side of the circuit board 21, and comprises an extension plate 220. A fixing auxiliary device 23 for fixing the metallic assembly 22 onto the circuit board 21 comprises a main body 230, two extension arms 231 and 232, and an adhesive element (not shown). The bottom of the main body 230 defines a leg potion 234. Firstly, the fixing auxiliary device 23 is coupled to the extension plate 220 of the metallic assembly 22. Then, the leg potion 234 is inserted into the insertion hole 210. Afterward, the leg potion 234 of the fixing auxiliary device 23 is welded onto the circuit board 21 by using the adhesive element (not shown). In such a manner, the fixing auxiliary device 23 is capable of facilitating secure attachment of the metallic assembly 22 onto the circuit board 21 and/or electrical connection between the metallic assembly 22 and the circuit board 21, thereby forming the packaging structure 2.

Figure 3B:
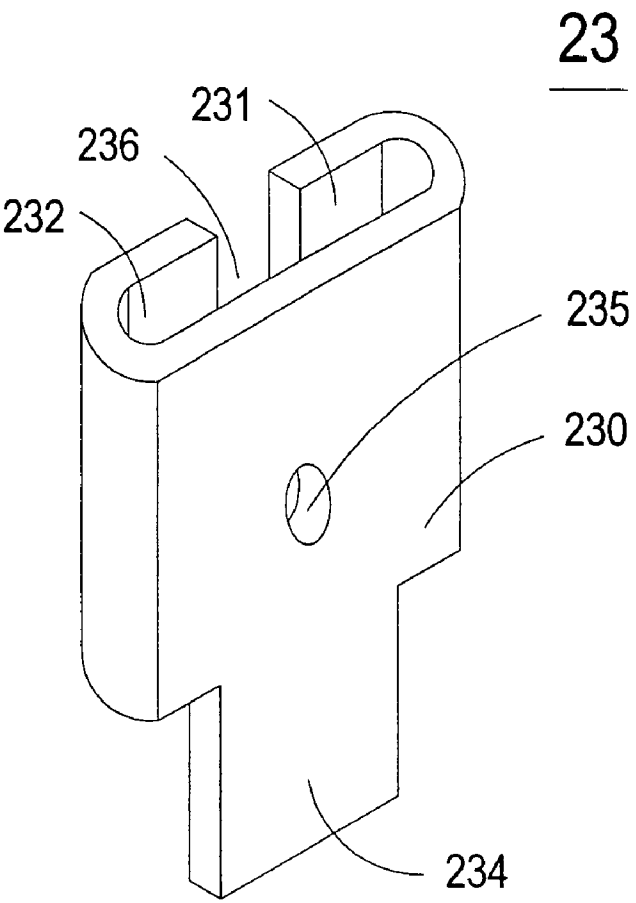
FIGS. 3(*a*) and 3(*b*) illustrate formation of the extension arms shown in FIG. 2.
Figure 3A:
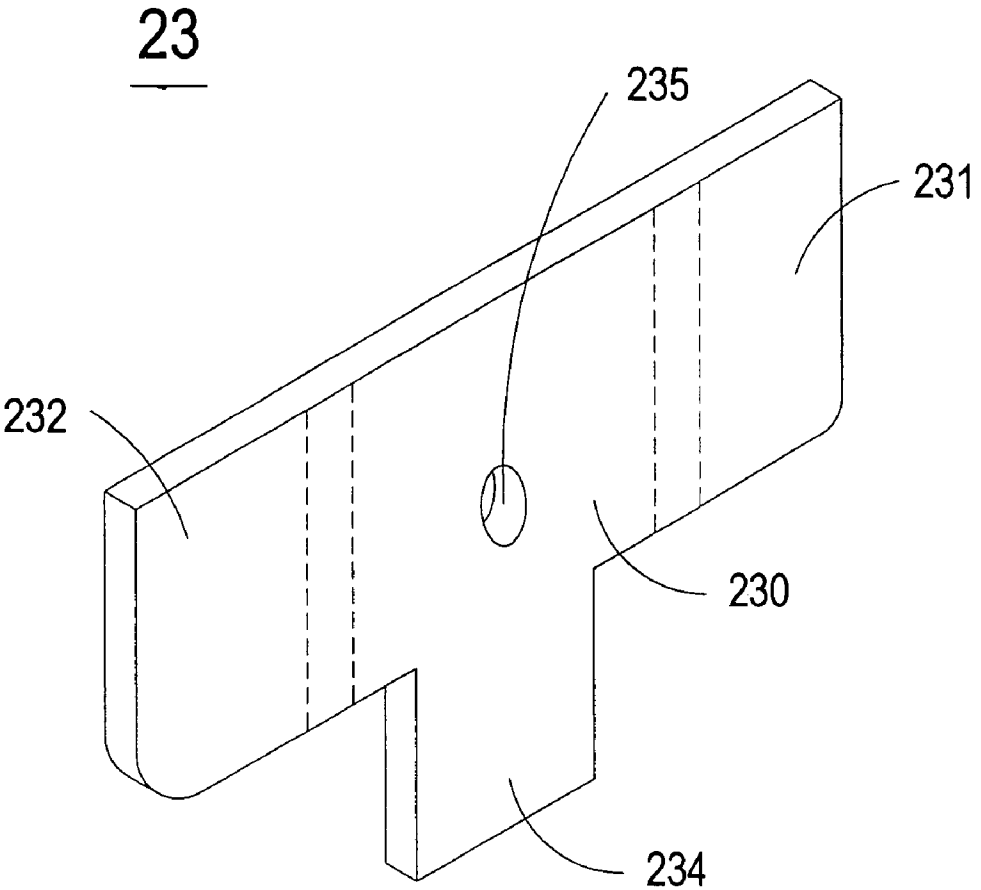

Please refer to FIGS. 3(*a*) and 3(*b*), which illustrate formation of the extension arms 231 and 232. Originally, the extension arms 231 and 232 are located at opposite edges of the main body 230, as shown in FIG. 3(*a*). After the extension arms 231 and 232 are bent toward the same side, an elongated slot 236 is defined between the extension arms 231 and 232 and the main body 230, as shown in FIG. 3(*b*). The width of the elongated slot 236 is substantially identical to that of the extension plate 220 of the metallic assembly 22, thereby accommodating the extension plate 220 therein.

Figure 4:
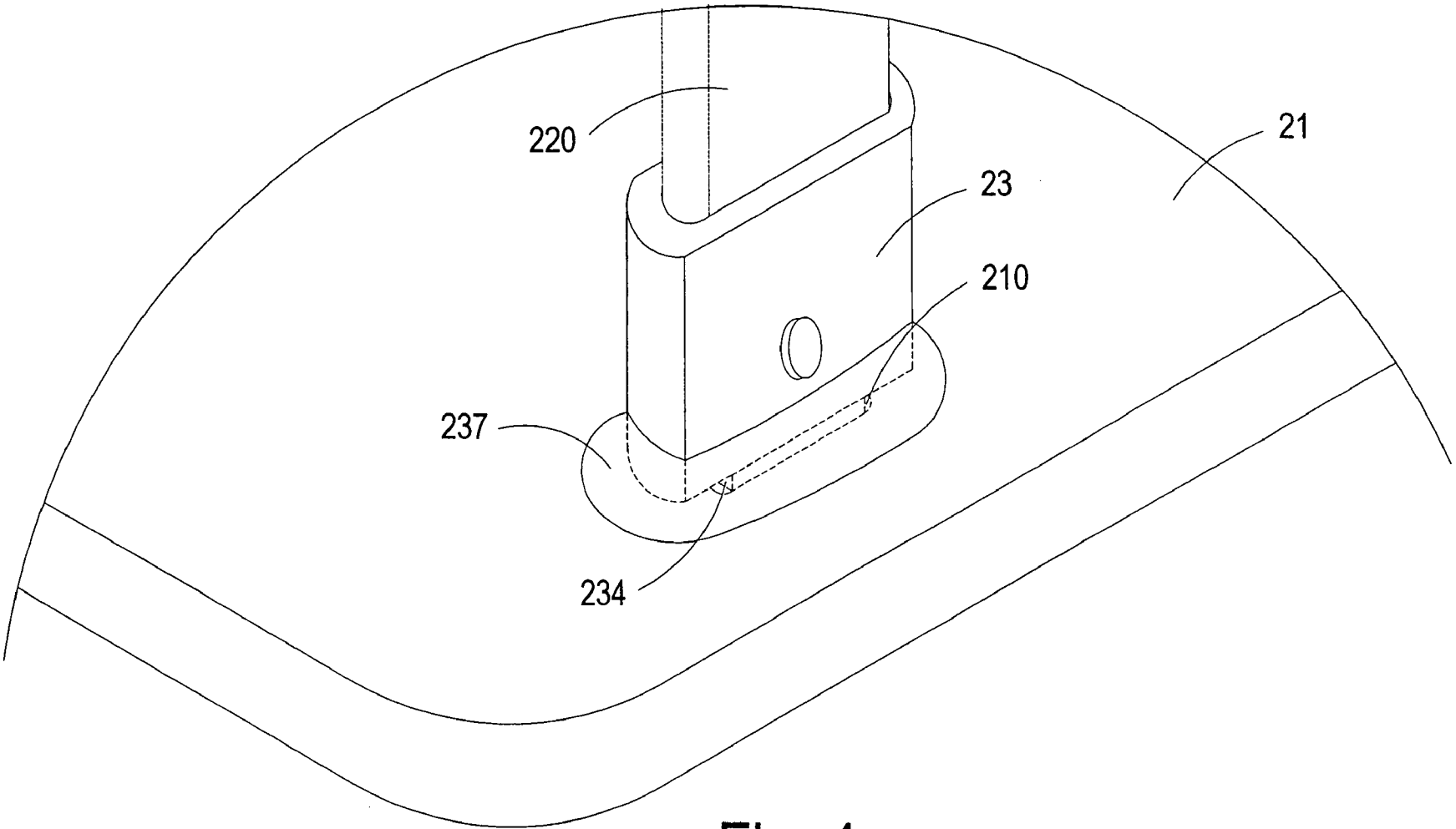
FIG. 4 illustrates the fixing auxiliary device of FIG. 2 welded onto the circuit board.

Referring to FIGS. 2 and 3, the main body 230 further comprises a first connecting structure 235 corresponding to a second connecting structure 221 of the extension plate 220. For example, the first connecting structure 235 is a perforation and the second connecting structure 221 is a protrusion part. After the protrusion part 221 of extension plate 220 is embedded into the perforation 235 of the main body 230, the extension arms 231 and 232 the leg potion 234 is inserted into the insertion hole 210. Afterward, the fixing auxiliary device 23 is welded onto the circuit board 21 by using an adhesive element 237, as shown in FIG. 4. Of course, the first connecting structure 235 can be a protrusion part and the second connecting structure 221 can be a perforation, alternatively.

Figure 5:
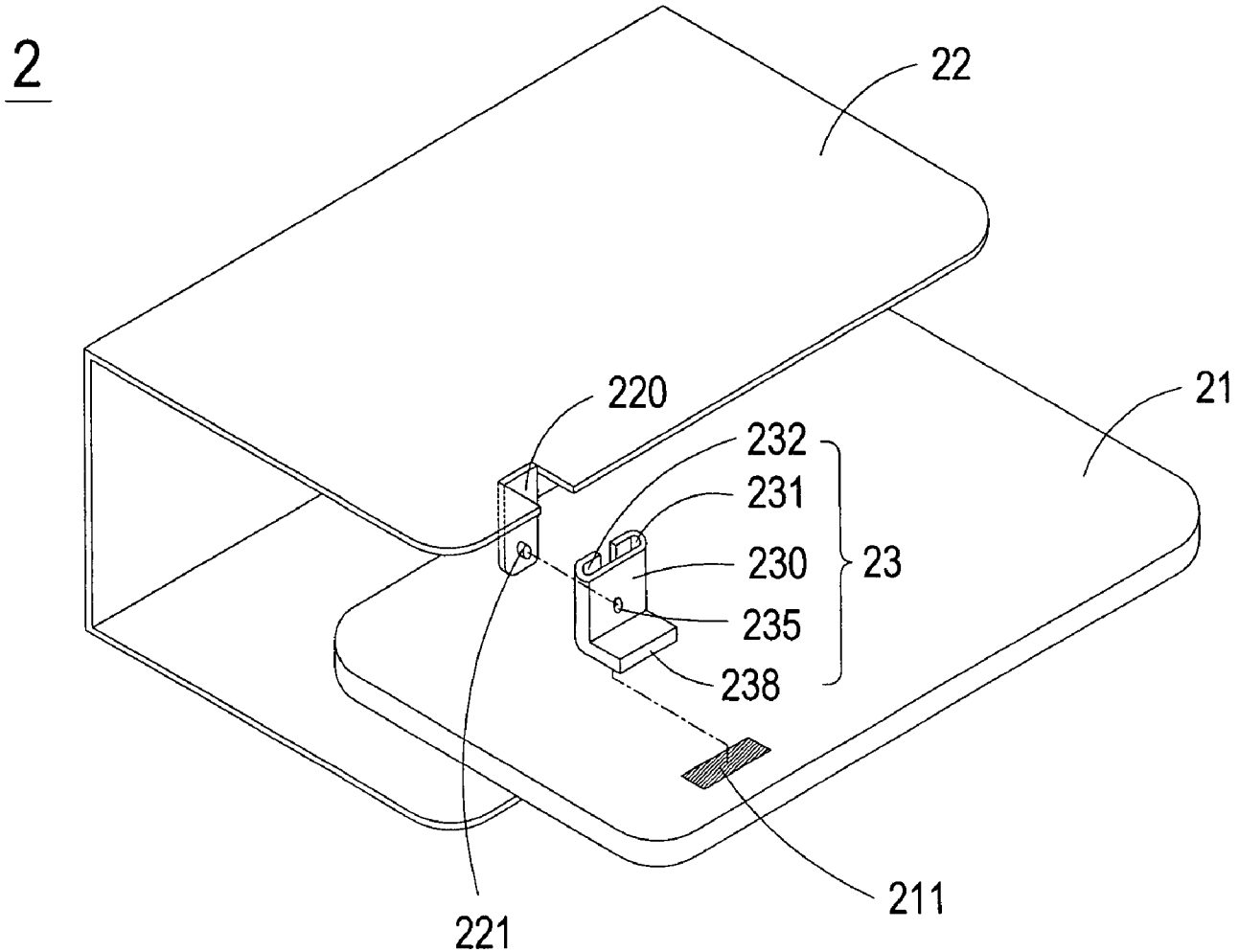
FIG. 5 illustrates a fixing auxiliary device for facilitating a user to fix a metallic assembly onto a circuit board according to another preferred embodiment of the present invention.

Referring to FIG. 5, a further embodiment of a fixing auxiliary device for facilitating a user to fix a metallic assembly onto a circuit board according to a preferred embodiment of the present invention is illustrated. The circuit board 21 has thereon one or more connecting portions such as a contact pad 211. The metallic assembly 22 is disposed on the front side and/or rear side of the circuit board 21, and comprises an extension plate 220. A fixing auxiliary devices 23 for fixing the metallic assembly 22 onto the circuit board 21 comprises a main body 230, two extension arms 231 and 232, and an adhesive element (not shown). The bottom of the main body 230 defines a bent potion 238, which is perpendicular to the main body 230 and parallel to the surface of the circuit board 21. Firstly, the fixing auxiliary device 23 is coupled to corresponding extension plate 220 of the metallic assembly 22. Then, the bent potion 238 is in contact with the contact pad 211. Afterward, the bent potion 238 of the fixing auxiliary device 23 is welded onto the circuit board 21 by using the adhesive element (not shown). In such a manner, the fixing auxiliary device 23 is capable of facilitating secure attachment of the metallic assembly 22 onto the circuit board 21 and/or electrical connection between the metallic assembly 22 and the circuit board 21, thereby forming the packaging structure 2.

Figure 6B:
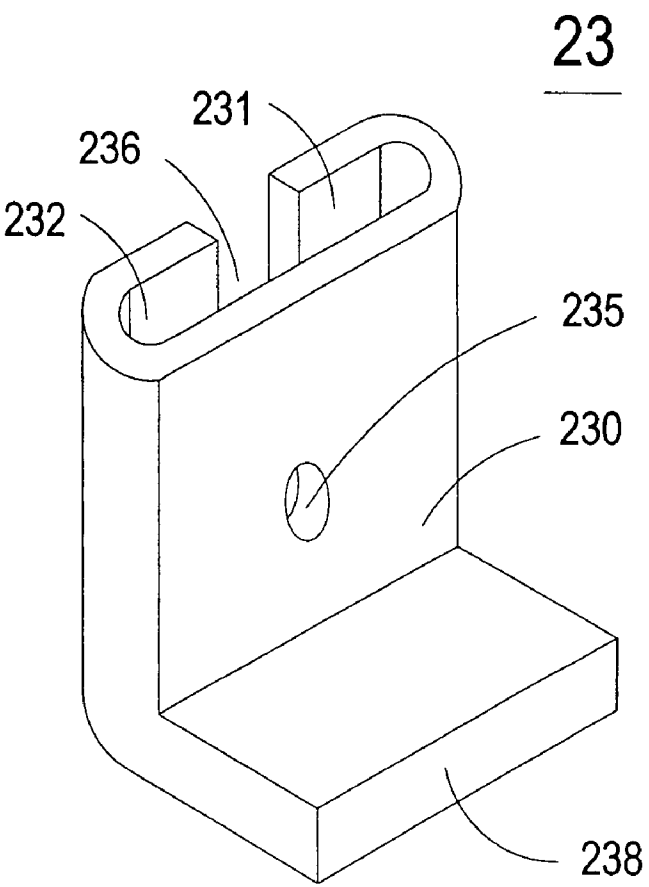
FIGS. 6(*a*) and 6(*b*) illustrate formation of the extension arms shown in FIG. 5.
Figure 6A:
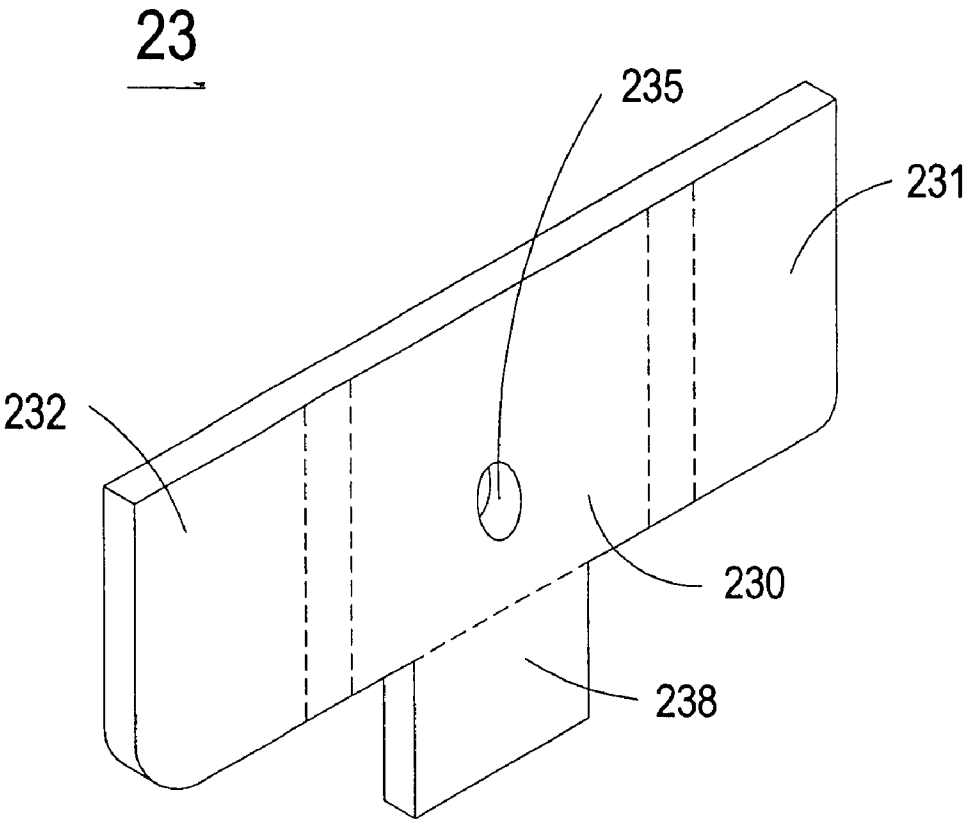

Please refer to FIGS. 6(*a*) and 6(*b*), which illustrate formation of the extension arms 231 and 232. Originally, the extension arms 231 and 232 are located at opposite edges of the main body 230, as shown in FIG. 6(*a*). After the extension arms 231 and 232 are bent toward the same side, an elongated slot 236 is defined between the extension arms 231 and 232 and the main body 230, as shown in FIG. 3(*b*). The width of the elongated slot 236 is substantially identical to that of the extension plate 220 of the metallic assembly 22, thereby accommodating the extension plate 220 therein. The bent potion 238 is created by bending the bottom of the main body 230 such that the bent portion 238 is perpendicular to the main body 230 and parallel to the surface of the circuit board 21.

Figure 7:
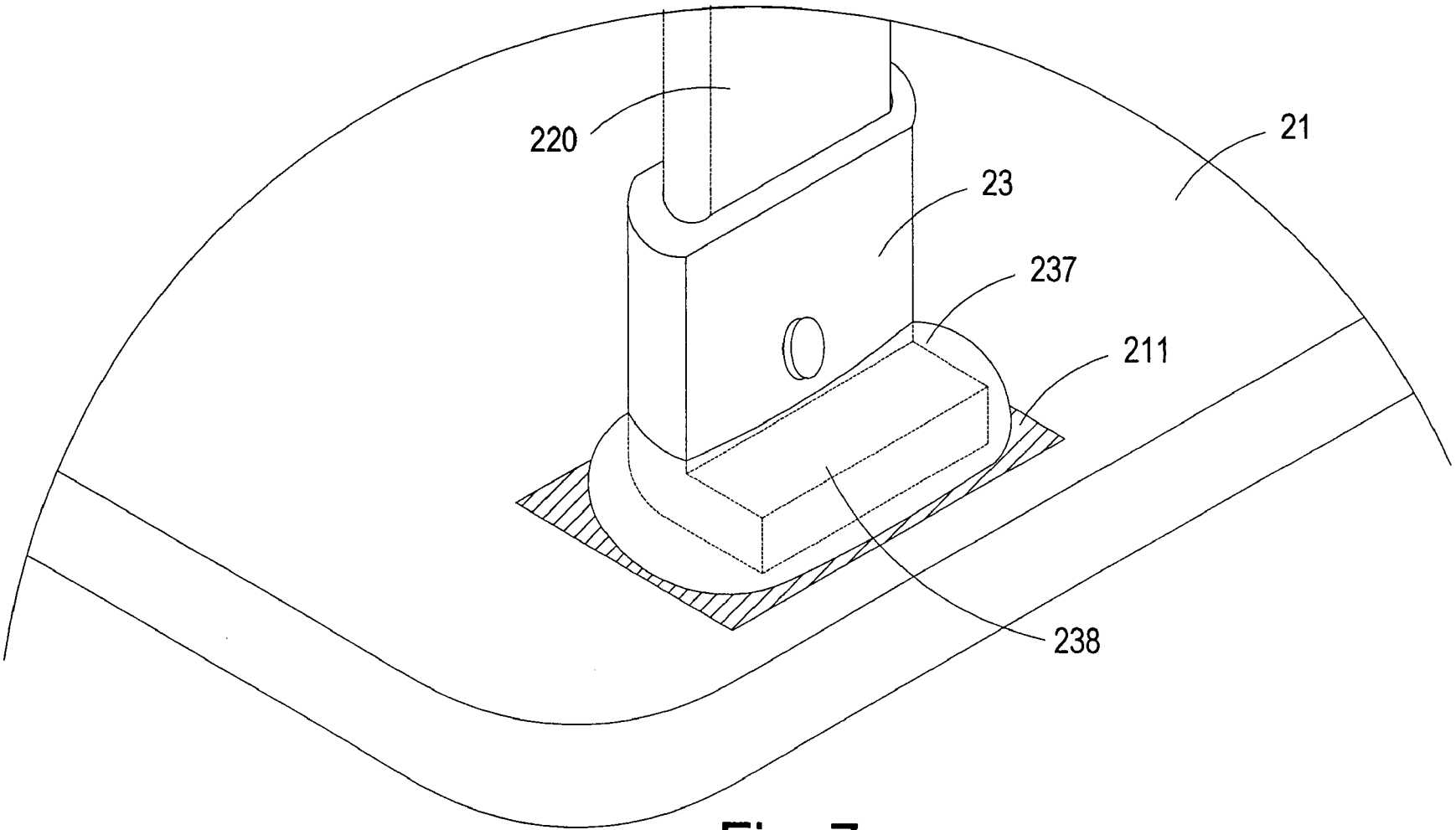
FIG. 7 illustrates the fixing auxiliary device of FIG. 5 welded onto the circuit board.

Referring to FIGS. 5 and 6, the main body 230 further comprises a first connecting structure 235 corresponding to a second connecting structure 221 of the extension plate 220. For example, the first connecting structure 235 is a perforation and the second connecting structure 221 is a protrusion part. The protrusion part 221 of the extension plate 220 is embedded into the perforation 235 of the main body 230. After the protrusion part 221 of the extension plate 220 is embedded into the perforation 235 of the main body 230, the extension arms 231 and 232 may clamp the extension plate 220 tightly when a clamping tool is used to clamp the external surfaces of the extension arms 231 and 232. The bent potion 238 is then placed on the contact pad 211. Afterward, the bent potion 238 of the fixing auxiliary device 23 is welded onto the circuitry board 21 by using the adhesive element 237, as shown in FIG. 7. Of course, the first connecting structure 235 can be a protrusion part and the second connecting structure 221 can be a perforation, alternatively.

In the above embodiments, the metallic assembly 22 used in the present invention may be an EMI shielding element or a heat sink. The insertion hole 210 can be a conductive via hole such as a ground via. In a case that the metallic assembly 22 is an EMI shielding element, the problem of EMI disruption would be minimized. In another case that the metallic assembly 22 is a heat sink, heat dissipation efficiency of the electronic device mounted on the circuit board 21 would be increased. Preferably, the extension arms 231 and 232 and the main body 230 are integrally formed. In addition, it is preferred that the leg potion 234 and the main body 230 are integrally formed. In some embodiments, the metallic assembly 22 is made of aluminum, and the main body 230 of the fixing auxiliary device 23 is made of copper or tin. An exemplary adhesive element 237 is a soldering material.

Figure 8:
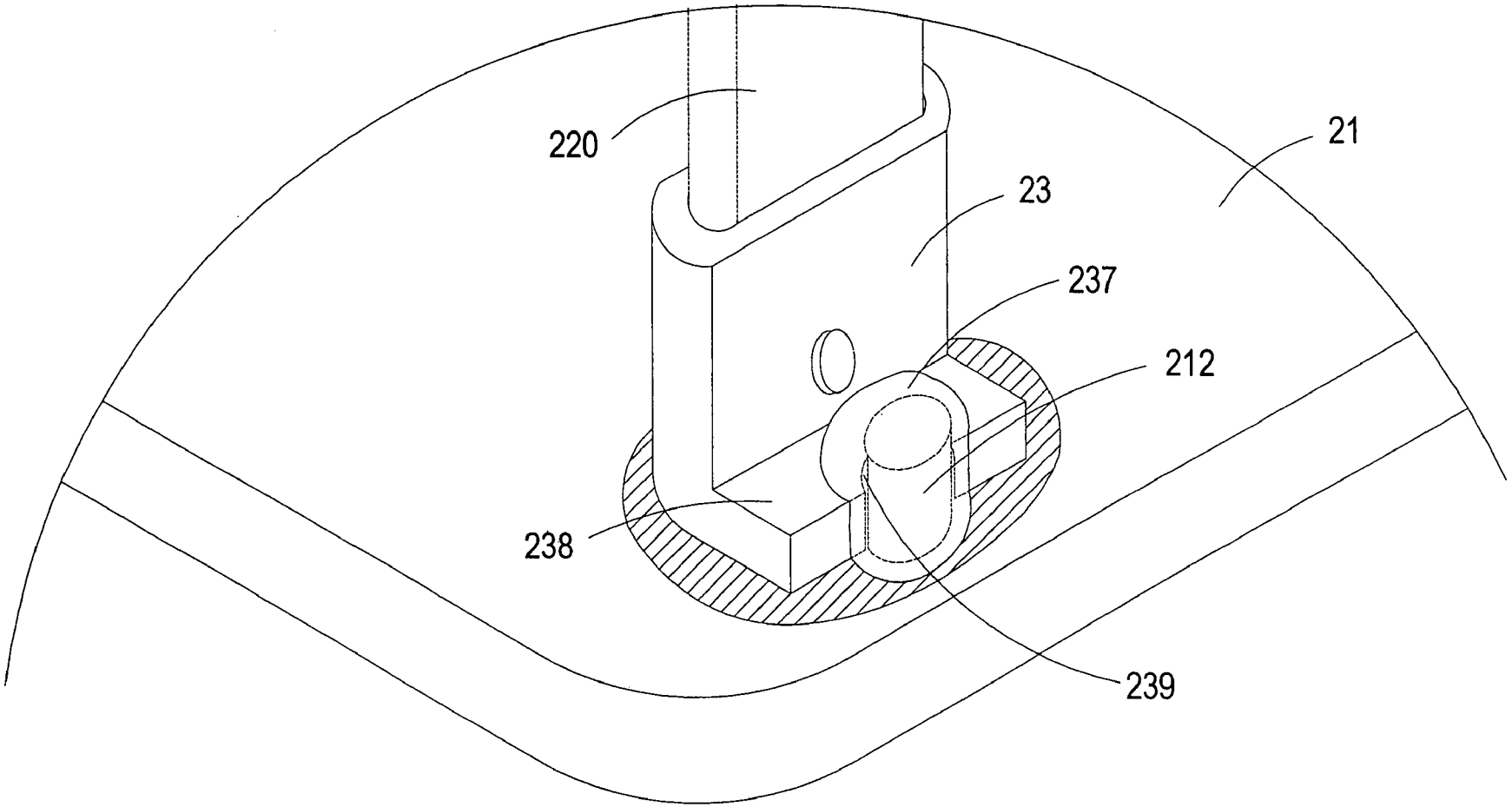
FIG. 8 illustrates a fixing auxiliary device for facilitating a user to fix a metallic assembly onto a circuit board according to a further preferred embodiment of the present invention.

Alternatively, as shown in FIG. 8, the connecting portion of the circuit board 21 further comprises a stub 212, and the bent potion 238 of the fixing auxiliary device 23 further comprises a curved channel 239 for partially accommodating the stub 212. Since the stub 212 is welded onto the circuit board 21 and bonded to the curved channel 239 by using the adhesive element 237, more secure attachment of the metallic assembly 22 onto the circuit board 21 and/or electrical connection between the metallic assembly 22 and the circuit board 21 is achieved.

From the above description, the fixing auxiliary device of the present invention is capable of facilitating a user to fix a metallic assembly onto a circuit board. In addition, since the fixing auxiliary device has a simple structure and the process for using the fixing auxiliary device is simplified, the process for packaging the metallic assembly on the circuit board is also simplified.

While the invention has been described in terms of what is presently considered to be the most practical and preferred embodiments, it is to be understood that the invention needs not be limited to the disclosed embodiment. On the contrary, it is intended to cover various modifications and similar arrangements included within the spirit and scope of the appended claims which are to be accorded with the broadest interpretation so as to encompass all such modifications and similar structures.

What is claimed is:

1. A fixing auxiliary device for facilitating a user to fix a metallic assembly onto a circuit board, said metallic assembly having at least an extension plate, said circuit board having at least a connecting portion, said fixing auxiliary device comprising:

a main body having a first portion in contact with said connecting portion of said circuit board and a second portion coupled to said extension plate of said metallic assembly, said second portion having a first connecting structure corresponding to a second connecting structure of said extension plate of said metallic assembly, and one of said first and second connecting structures being embedded into the other of said first and second connecting structures for positioning said fixing auxiliary device onto said extension plate of said metallic assembly;

at least an extension arm extending from an edge of said main body and bent toward one side of said main body so as to clamp said extension plate of said metallic assembly; and an adhesive element for bonding said first portion of said main body onto said connecting portion of said circuit board.

2. The fixing auxiliary device according to claim 1 wherein said metallic assembly is one of an EMI shielding element and a heat sink.

3. The fixing auxiliary device according to claim 1 wherein said connecting portion of said circuit board includes an insertion hole, and said first portion of said main body is a leg portion inserting into said insertion hole of said circuit board.

4. The fixing auxiliary device according to claim 3 wherein said insertion hole is a conductive via hole, and said leg portion is disposed at the bottom of said main body and integrally formed with said main body.

5. The fixing auxiliary device according to claim 1 wherein said connecting portion of said circuit board includes a contact pad, and said first portion of said main body is a bent portion perpendicular to said main body and parallel to a surface of said circuit board.

6. The fixing auxiliary device according to claim 5 wherein said connecting portion of said circuit board further includes a stub, and said first portion of said main body is a bent portion having a curved channel for partially accommodating said the stub.

7. The fixing auxiliary device according to claim 1 wherein one of said first and second connecting structures is a perforation and the other of said first and second connecting structures is a protrusion part and said protrusion part is embedded into said perforation.

8. The fixing auxiliary device according to claim 1 wherein said at least an extension arm comprises two extension arms extending from opposite edges of said main body and bent toward the same side of said main body so as to tightly clamp said extension plate of said metallic assembly.

9. The fixing auxiliary device according to claim 1 wherein said at least an extension arm is integrally formed with said main body.

10. The fixing auxiliary device according to claim 1 wherein said metallic assembly is made of aluminum, and said main body of said fixing auxiliary device is made of copper or tin.

11. The fixing auxiliary device according to claim 1 wherein said adhesive element is made of a soldering material.

12. A packaging structure of a metallic assembly, comprising:

a circuit board having at least a connecting portion;

a metallic assembly mounted on a surface of said circuit board and having at least an extension plate; and a fixing auxiliary device for facilitating a user to fix said metallic assembly onto said circuit board, and comprising:

a main body having a first portion in contact with said connecting portion of said circuit board and a second portion coupled to said extension plate of said metallic assembly, said second portion having a first connecting structure corresponding to a second connecting structure of said extension plate of said metallic assembly, and one of said first and second connecting structures being embedded into the other of said first and second connecting structures for positioning said fixing auxiliary device onto said extension plate of said metallic assembly;

at least an extension arm extending from an edge of said main body and bent toward one side of said main body so as to clamp said extension plate of said metallic assembly; and an adhesive element for bonding said first portion of said main body onto said connecting portion of said circuit board.

13. The packaging structure according to claim 12 wherein said metallic assembly is one of an EMI shielding element and a heat sink.

14. The packaging structure according to claim 12 wherein said connecting portion of said circuit board includes an insertion hole, and said first portion of said main body is a leg portion inserting into said insertion hole of said circuit board.

15. The packaging structure according to claim 14 wherein said insertion hole is a conductive via hole, and said leg portion is disposed at the bottom of said main body and integrally formed with said main body.

16. The packaging structure according to claim 12 wherein said connecting portion of said circuit board includes a contact pad, and said first portion of said main body is a bent portion perpendicular to said main body and parallel to a surface of said circuit board.

17. The packaging structure according to claim 16 wherein said connecting portion of said circuit board further includes a stub, and said first portion of said main body is a bent portion having a curved channel for partially accommodating said the stub.

18. The packaging structure according to claim 12 wherein one of said first and second connecting structures is a perforation and the other of said first and second connecting structures is a protrusion part, and said protrusion part is embedded into said perforation.

19. The packaging structure according to claim 12 wherein said at least an extension arm comprises two extension arms extending from opposite edges of said main body and bent toward the same side of said main body so as to tightly clamp said extension plate of said metallic assembly.

20. The packaging structure according to claim 12 wherein said at least an extension arm is integrally formed with said main body.

* * * * *